US012501968B2

(12) United States Patent
Taoka et al.

(10) Patent No.: US 12,501,968 B2
(45) Date of Patent: Dec. 23, 2025

(54) SOLE AND SHOE INCLUDING THE SAME

(71) Applicant: ASICS CORPORATION, Kobe (JP)

(72) Inventors: Azumi Taoka, Kobe (JP); Sho Takamasu, Kobe (JP); Sho Kubota, Kobe (JP); Tomoichiro Ozaki, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/624,711

(22) Filed: Apr. 2, 2024

(65) Prior Publication Data

US 2024/0341406 A1 Oct. 17, 2024

(30) Foreign Application Priority Data

Apr. 12, 2023 (JP) ..... 2023-065001

(51) Int. Cl.
*A43B 13/18* (2006.01)
*A43B 13/12* (2006.01)
*A43B 13/14* (2006.01)

(52) U.S. Cl.
CPC ..... *A43B 13/181* (2013.01); *A43B 13/125* (2013.01); *A43B 13/141* (2013.01)

(58) Field of Classification Search
CPC ..... A43B 23/22; A43B 23/222; A43B 23/227; A43B 13/141; A43B 13/181; A43B 13/183; A43B 13/127; A43B 13/41
See application file for complete search history.

(56) References Cited

U.S. PATENT DOCUMENTS 5,046,267 A * 9/1991 Kilgore ..... A43B 7/24 36/31
D410,965 S * 6/1999 Schuette ..... D2/947
6,119,373 A * 9/2000 Gebhard ..... A43B 3/14 36/31
D433,213 S * 11/2000 Schuette ..... D2/947
7,082,702 B2 * 8/2006 Cretinon ..... A43B 13/026 36/76 R (Continued)

FOREIGN PATENT DOCUMENTS

EP 2979568 A1 2/2016
EP 3494823 A1 6/2019

(Continued)

OTHER PUBLICATIONS

Extended European Search Report issued in EP 24 16 8423.2-1015 by the European Patent Office on Aug. 26, 2024 which is related to U.S. Appl. No. 18/624,711.

*Primary Examiner* — Megan E Lynch
(74) *Attorney, Agent, or Firm* — Studebaker Brackett PLLC

(57) ABSTRACT

A sole includes: a midsole located to continuously extend from a forefoot portion to a rearfoot portion; and a reinforcing member formed of a material higher in rigidity than a material forming the midsole and disposed on a bottom surface of the midsole. The reinforcing member includes: a first bar located to extend at least in the forefoot portion and the midfoot portion and extending along a lateral foot-side end portion of the midsole; and a second bar located in the forefoot portion, having one end connected to the first bar, and extending in an oblique direction to extend rearward toward a medial foot side.

15 Claims, 10 Drawing Sheets

(56) References Cited

U.S. PATENT DOCUMENTS

| | | | | |
|---|---|---|---|---|
| 7,818,897 | B2 * | 10/2010 | Geer | B29D 35/061 36/31 |
| 7,997,013 | B2 * | 8/2011 | Reilly | A43B 13/12 36/107 |
| 8,365,440 | B2 * | 2/2013 | Rivas | A43B 7/18 36/107 |
| D726,398 | S * | 4/2015 | Grott | D2/947 |
| 9,089,185 | B2 * | 7/2015 | Nishiwaki | A43B 13/12 |
| 9,615,625 | B1 * | 4/2017 | Huard | A43B 13/141 |
| 2001/0001907 | A1 * | 5/2001 | Luthi | A43B 7/1425 36/144 |
| 2008/0289220 | A1 * | 11/2008 | Rivas | A43B 13/141 36/35 R |
| 2013/0061496 | A1 * | 3/2013 | Lawlor | A43B 7/1464 36/114 |
| 2016/0029741 | A1 * | 2/2016 | Foxen | A43B 13/188 36/103 |
| 2017/0245590 | A1 * | 8/2017 | Kohatsu | A43B 13/127 |
| 2019/0029363 | A1 * | 1/2019 | Lucca | A43B 13/04 |
| 2020/0214389 | A1 * | 7/2020 | Hatano | A43B 13/181 |
| 2022/0151337 | A1 | 5/2022 | Fujita et al. | |
| 2024/0188680 | A1 * | 6/2024 | Ishikawa | A43B 13/026 |

FOREIGN PATENT DOCUMENTS

| | | | | |
|---|---|---|---|---|
| EP | 4302630 | A1 | 1/2024 | |
| JP | 2007-135824 | A | 6/2007 | |
| WO | WO-2010006906 | A1 * | 1/2010 | A43B 13/026 |
| WO | 2014/155511 | A1 | 10/2014 | |
| WO | 2019/073504 | A1 | 4/2019 | |
| WO | 2022/215203 | A1 | 10/2022 | |

* cited by examiner

SOLE AND SHOE INCLUDING THE SAME

REFERENCE TO RELATED APPLICATIONS

This nonprovisional application is based on Japanese Patent Application No. 2023-065001 filed on Apr. 12, 2023 with the Japan Patent Office, the entire contents of which are hereby incorporated by reference.

BACKGROUND

Technical Field

The present disclosure relates to a sole and a shoe including the sole.

Background Information

For example, documents such as WO2019/073504, WO2022/215203 disclose a sole having a reinforcing member and a shoe including the sole. The reinforcing member provided in the sole disclosed in each of PTLs 1 and 2 is designed particularly to allow a quick and smooth change in direction in the left-right direction (what is called a cutting maneuver).

In other words, in the sole disclosed in the above-mentioned publications, a portion of the reinforcing member that is provided in a midfoot portion extends in an oblique direction, and thus, the sole easily undergoes twisting specifically in a portion between a medial foot-side portion in a forefoot portion and a lateral foot-side portion in a rearfoot portion, so that the impulse of braking applied during a cutting maneuver increases accordingly. Thus, due to such an increase in impulse, a quick and smooth cutting maneuver can be implemented.

SUMMARY

Specific ball games typified by tennis, volleyball, badminton, and the like not only involve the above-mentioned cutting maneuver but also frequently involve a forward start-off action requiring an instantaneous speed. In this respect, in the sole disclosed in each of the above-mentioned publications, the portion of the reinforcing member that is provided in the midfoot portion extends in the oblique direction as described above, which increases the flexural rigidity against the dorsal flexion occurring in the sole when a foot lands on the ground, and thereby also provides a function of assisting the start-off action.

However, with respect to the action of a foot, which receives the wearer's weight first and is pulled backward (hereinafter referred to as a pull-back foot), from when it lands as the first step on the ground to when it lifts off the ground in the forward start-off action requiring an instantaneous speed as described above, the foot as a pull-back foot lands on the ground in such a manner that a toe portion on the medial foot side first comes into contact with the ground, then the toe portion and a ball portion entirely land on the ground, and thereafter, the ball portion and the toe portion lift off the ground in this order while keeping an arch portion and a heel portion raised so as not to contact the ground, and finally, the toe portion on the medial foot side lifts off the ground. In this way, in the case of the foot as a pull-back foot, the heel portion does not land on the ground during a landing action, which is different from the motion in the landing action performed during normal walking or running.

Thus, in consideration of the above-described points, the sole is allowed to have a function of assisting the forward start-off action requiring an instantaneous speed, which makes it possible to implement a sole allowing a further quick and smooth start-off action and a shoe including the sole.

Accordingly, the present disclosure has been made in view of the above-described problems, and an object of the present disclosure is to provide: a sole allowing a forward start-off action requiring an instantaneous speed to be performed quickly with high propulsive force; and a shoe including the sole.

A sole according to an aspect of the present disclosure includes: a forefoot portion that is configured to support a toe portion and a ball portion of a foot of a wearer; a midfoot portion that is configured to support an arch portion of the foot of the wearer; and a rearfoot portion that is configured to support a heel portion of the foot of the wearer, the forefoot portion, the midfoot portion, and the rearfoot portion being connected in a front-rear direction corresponding to a foot length direction of the foot of the wearer. The sole includes: a midsole which continuously extends from the forefoot portion to the rearfoot portion; and a reinforcing member including a material higher in rigidity than a material of the midsole, the reinforcing member being on a bottom surface of the midsole. The reinforcing member includes: a first bar extending at least in the forefoot portion and the midfoot portion and extending along a lateral foot-side end portion of the midsole; and a second bar in the forefoot portion and having one end connected to the first bar, the second bar extending in an oblique direction to extend rearward toward a medial foot side in a left-right direction corresponding to a foot width direction of the foot of the wearer.

A shoe according to an aspect of the present disclosure includes: the sole according to the above-described aspect of the present disclosure; and an upper above the sole.

The foregoing and other objects, features, aspects, and advantages of the present disclosure will become apparent from the following detailed description of the present disclosure, which is understood in conjunction with the accompanying drawings.

DETAILED DESCRIPTION

Figure 1:
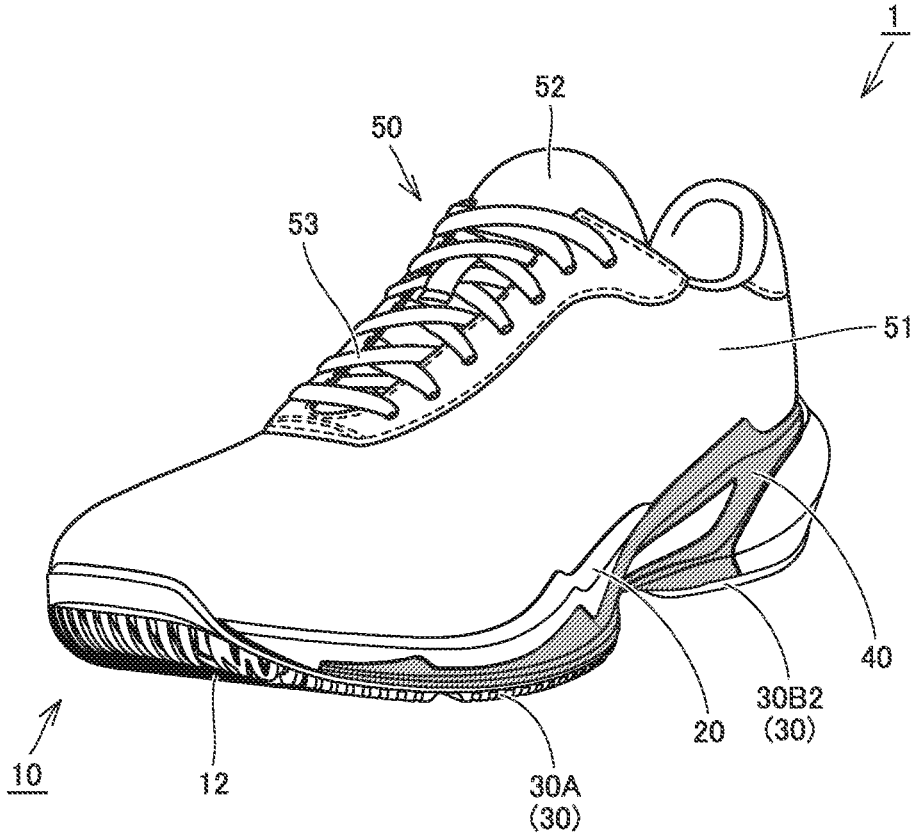
FIG. 1 is a schematic perspective view of a shoe according to an embodiment.

The following describes embodiments in detail with reference to the accompanying drawings. In the embodiments described below, the same or corresponding portions are denoted by the same reference characters, and the description thereof will not be repeated.

Embodiments

Figure 2:
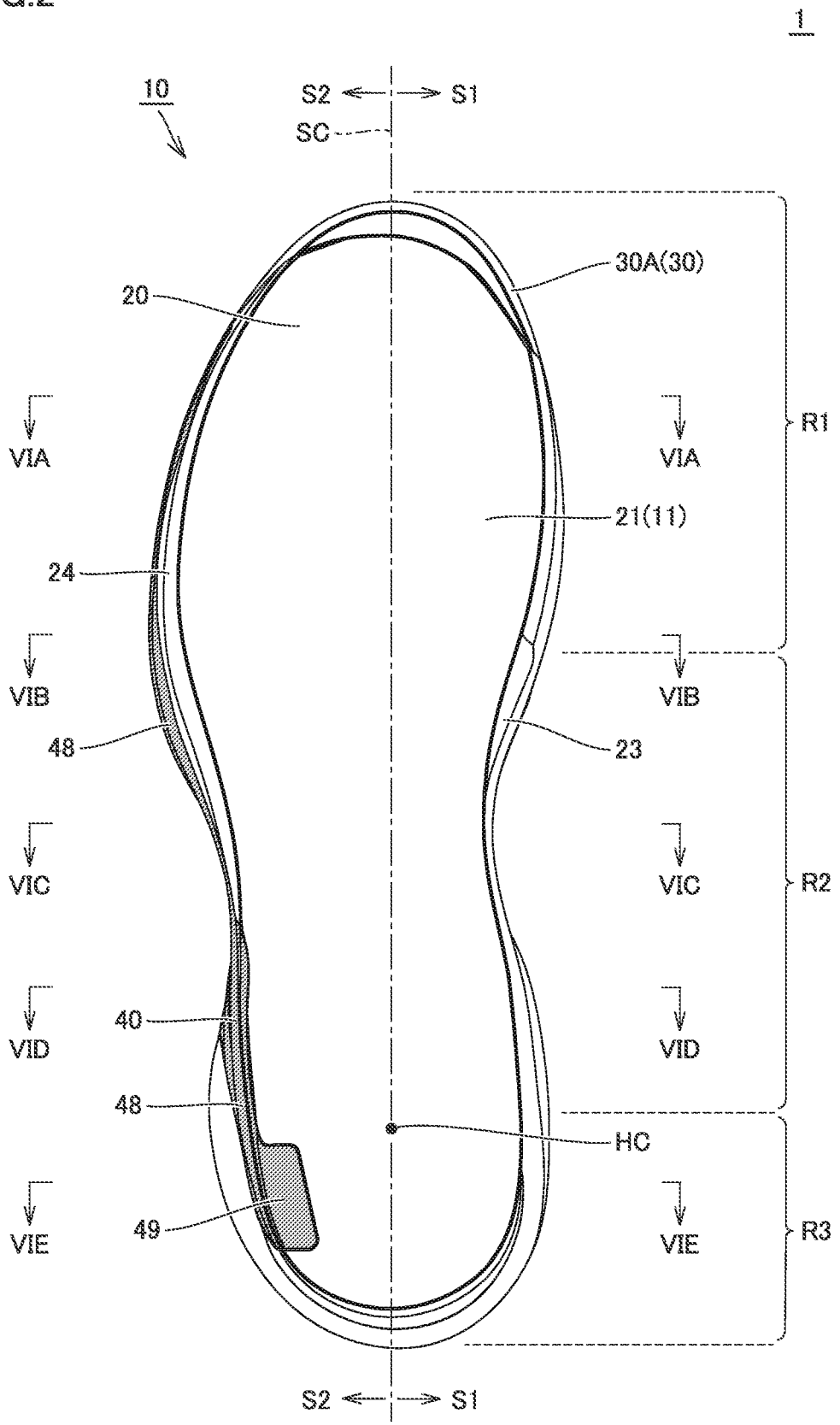
FIG. 2 is a schematic plan view of a sole shown in FIG. 1.
Figure 3:
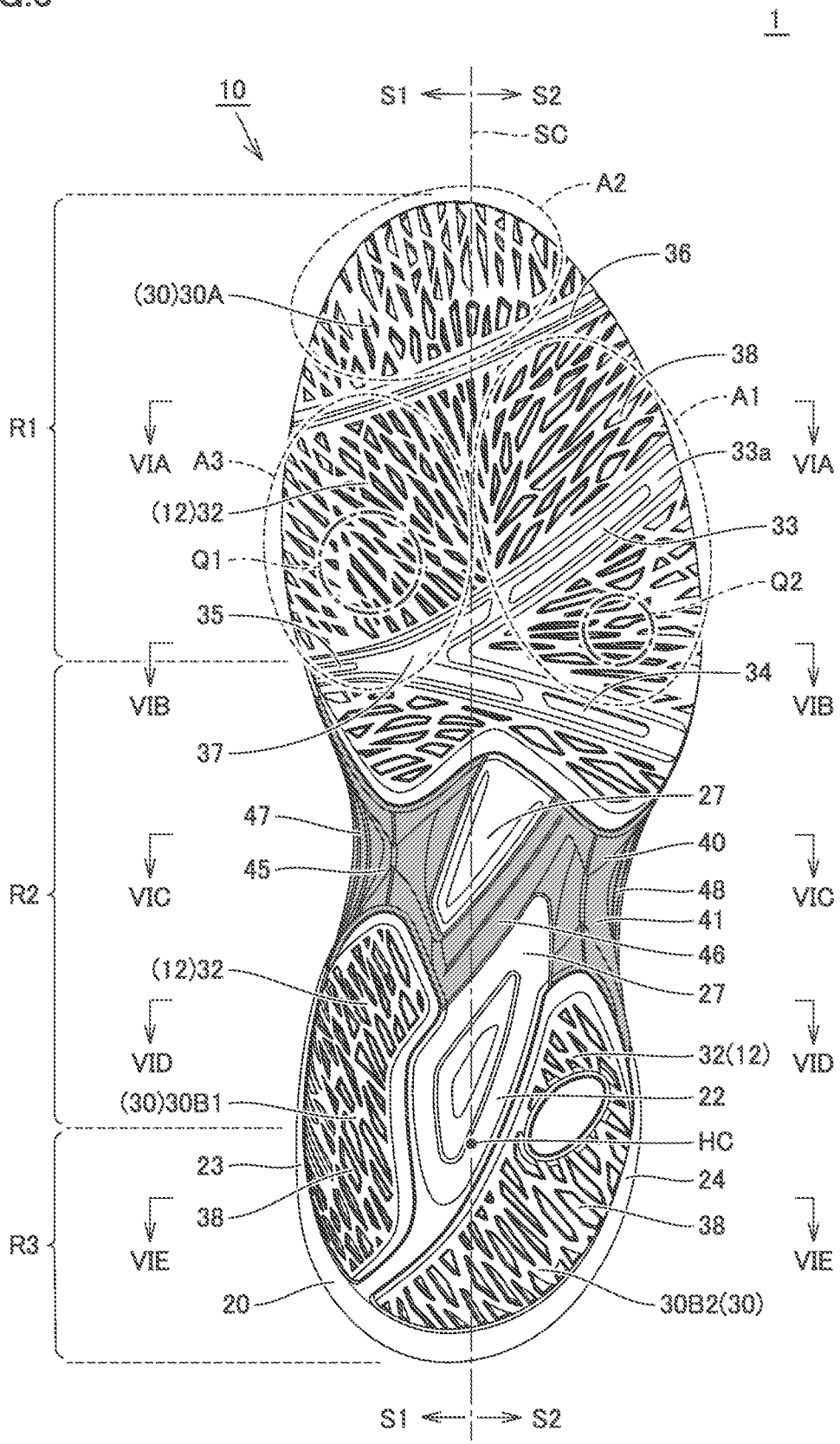
FIG. 3 is a schematic bottom view of the sole shown in FIG. 1.
Figure 4:
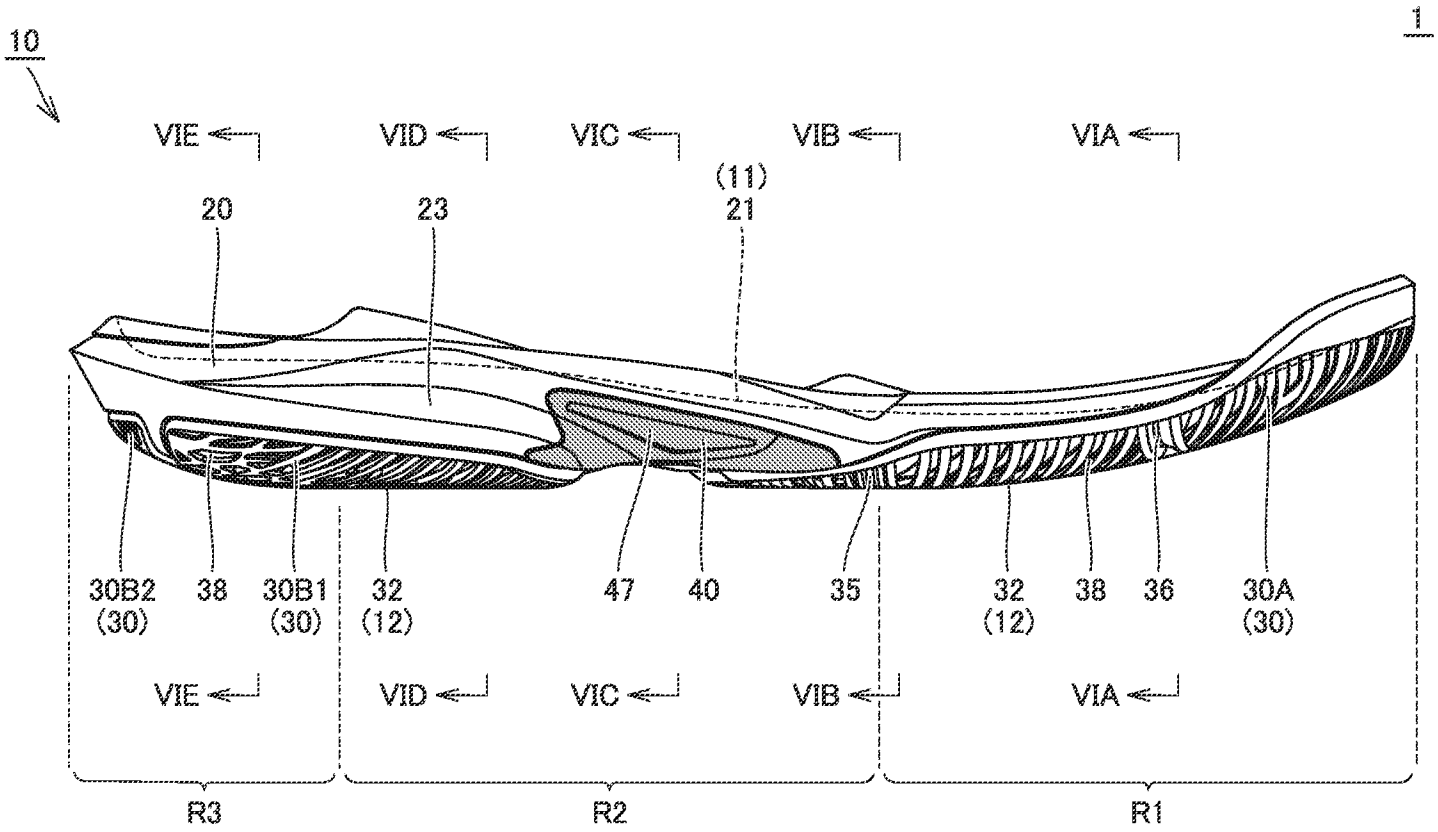
FIG. 4 is a schematic side view of the sole shown in FIG. 1 when viewed from a medial foot side.
Figure 5:
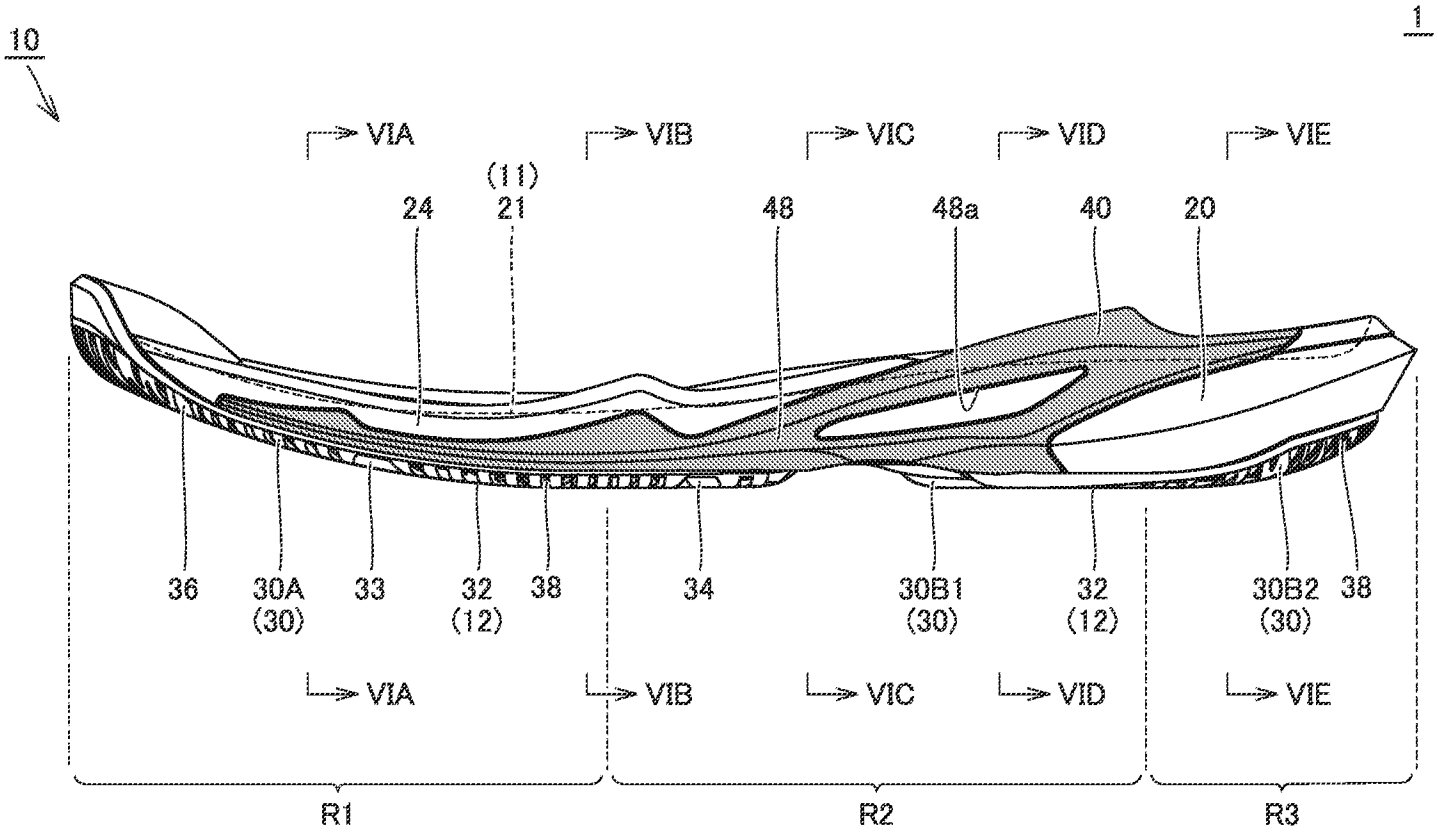
FIG. 5 is a schematic side view of the sole shown in FIG. 1 when viewed from a lateral foot side.
Figure 6A:
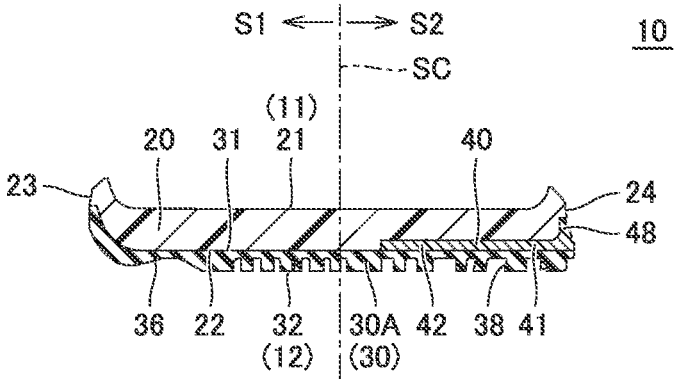
FIGS. 6A to 6E are schematic cross-sectional views of respective portions of the sole shown in FIG. 1.
Figure 6B:
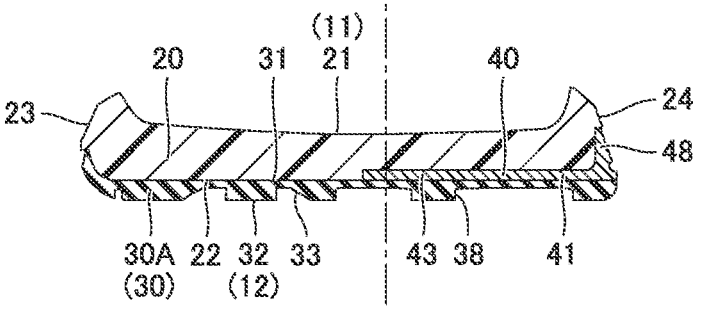
Figure 6C:
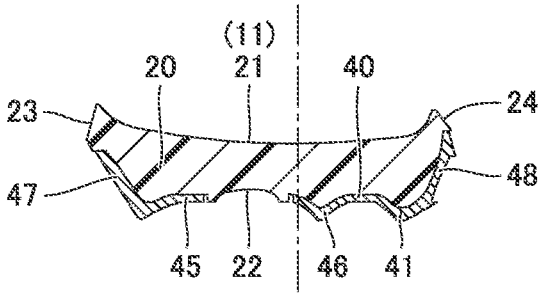
Figure 6D:
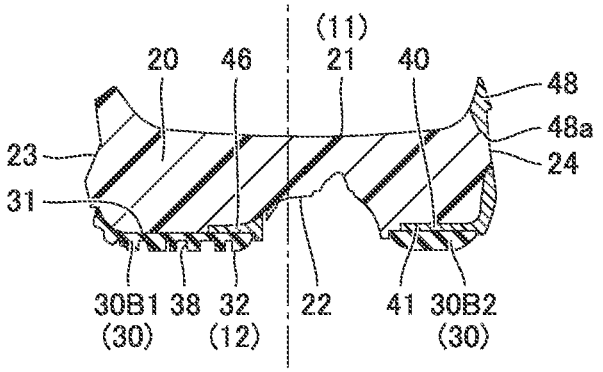
Figure 6E:
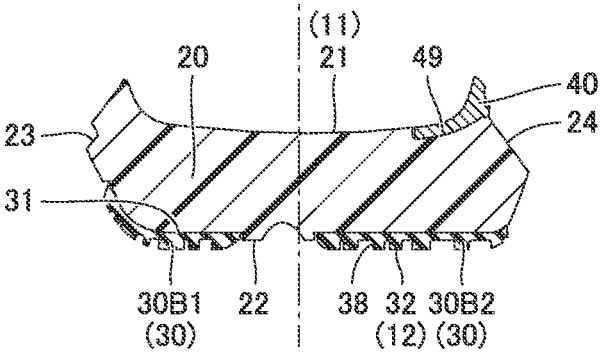
Figure 7:
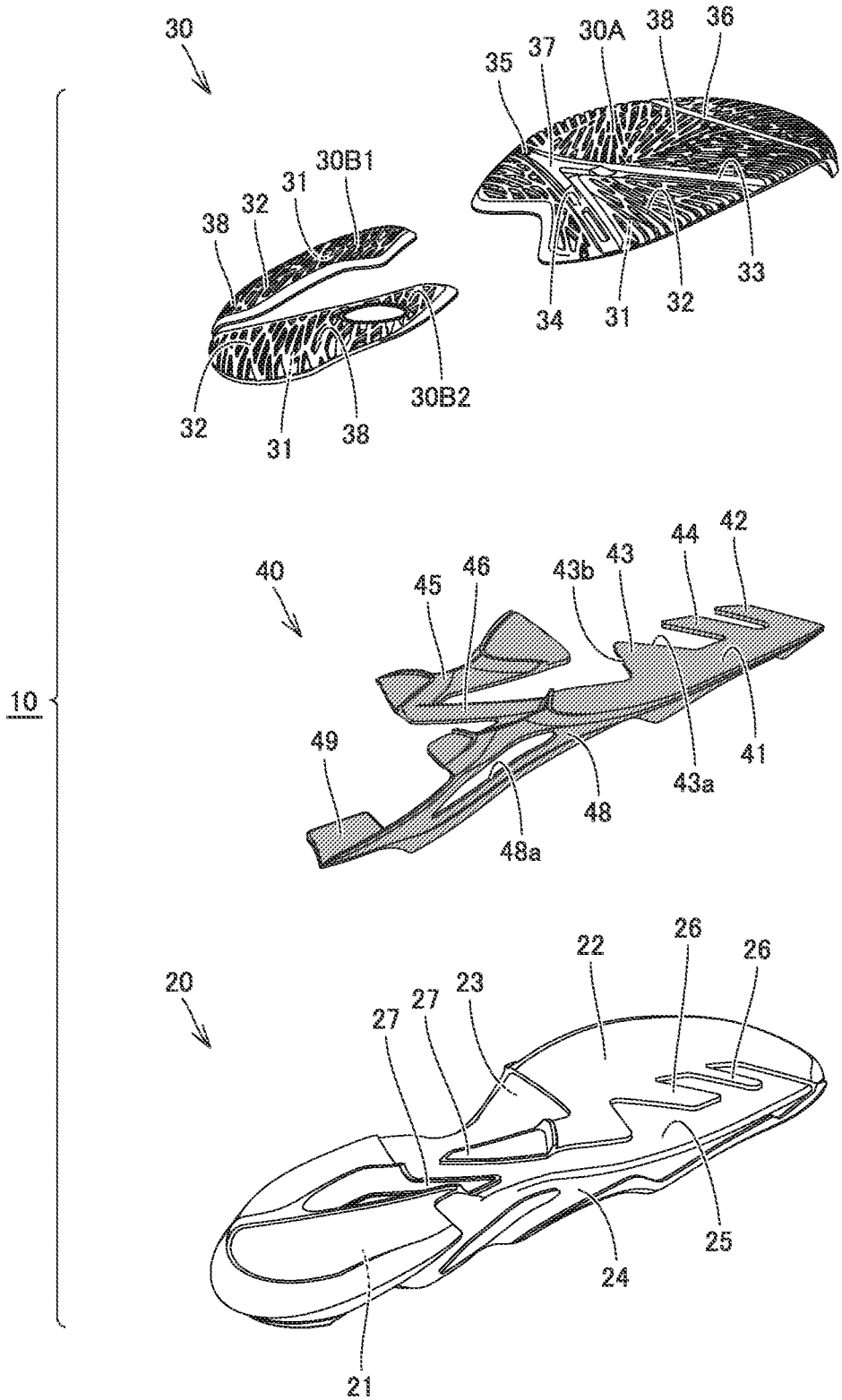
FIG. 7 is an exploded perspective view of the sole shown in FIG. 1.
Figure 8:
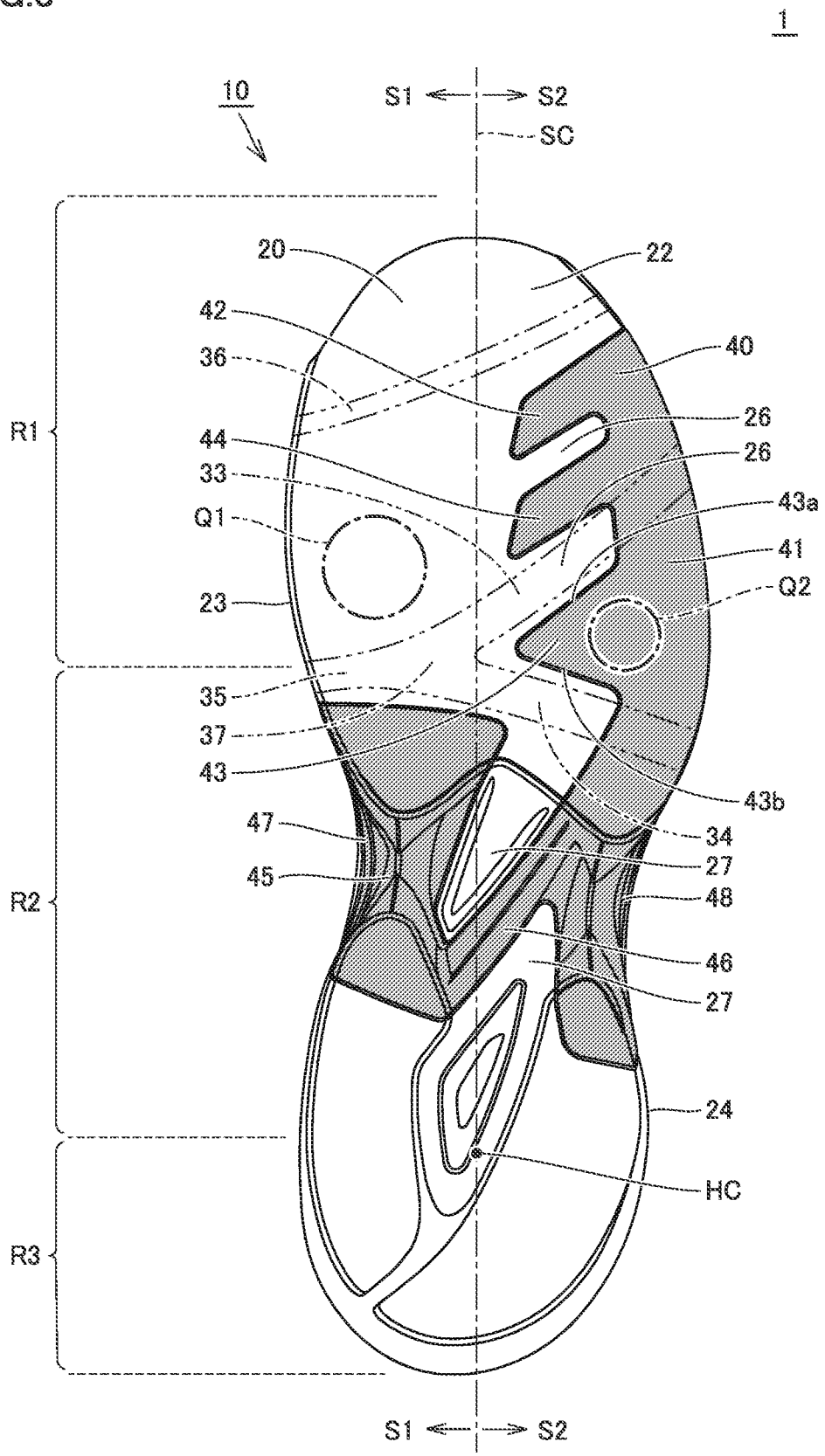
FIG. 8 is a schematic bottom view showing a state in which an outsole is removed from the sole shown in FIG. 1.

FIG. 1 is a schematic perspective view of a shoe according to an embodiment. FIGS. 2 and 3 are a schematic plan view and a schematic bottom view, respectively, of a sole shown in FIG. 1. FIGS. 4 and 5 are schematic side views of the sole shown in FIG. 1 when respectively viewed from a medial foot side and a lateral foot side. FIGS. 6A to 6E are schematic cross-sectional views respectively taken along lines VIA-VIA to VIE-VIE shown in FIGS. 2 to 5. FIG. 7 is an exploded perspective view of the sole shown in FIG. 1, and FIG. 8 is a schematic bottom view showing the state in which an outsole is removed from the sole shown in FIG. 1. Referring to these FIGS. 1 to 8, the following describes a sole 10 according to the present embodiment and a shoe 1 including the sole 10.

As will be described later, the sole 10 according to the present embodiment and the shoe 1 including the sole 10 are designed to allow a forward start-off action requiring an instantaneous speed to be performed quickly with high propulsive force.

As described above, specifically with respect to the action of a foot functioning as a pull-back foot from when it lands as the first step on the ground to when it lifts off the ground in the forward start-off action requiring an instantaneous speed as described above, the foot (a pull-back foot) lands on the ground in such a manner that a toe portion on the medial foot side first comes into contact with the ground, then the toe portion and a ball portion entirely land on the ground, and thereafter, the ball portion and the toe portion lift off the ground in this order while keeping an arch portion and a heel portion raised so as not to contact the ground, and finally, the toe portion on the medial foot side lifts off the ground.

In this case, the heel portion does not land on the ground. Thus, the trajectory of the movement of the center point of the pressure applied to the sole from when the foot (a pull-back foot) lands on the ground to when it lifts off the ground remains only in a medial foot-side portion in a forefoot portion, and the center point of the pressure moves in an oblique direction that connects the front end-side position on the medial foot side and the center position in the left-right direction as a boundary between the forefoot portion and a midfoot portion.

In this case, when a reinforcing member is provided in the forefoot portion to increase the flexural rigidity of the sole, the flexural rigidity against the dorsal flexion occurring in the sole is increased. Thus, the forward propulsive force is expected to increase, but a gap is produced between the movement of the wearer's foot and the deformation of the shoe including the sole, with the result that the force caused by the wearer's foot kicking the ground may not be able to be efficiently transmitted through the sole to the ground. Thus, in the case where the flexural rigidity of the sole is increased simply in its forefoot portion, the forward propulsive force may be impaired to the contrary.

Therefore, in order to provide the sole with a function of assisting the forward start-off action requiring an instantaneous speed, it is necessary to achieve both an increase in flexural rigidity of the sole in its forefoot portion and the ease of deformability of the sole in accordance with the movement of the wearer's foot.

In this respect, as will be described later, in the sole 10 according to the present embodiment and the shoe 1 including the sole 10, the reinforcing member provided mainly in the sole 10 is modified in terms of designs such as a shape and an arrangement position for improvement, to thereby achieve both an increase in flexural rigidity of the sole 10 in its forefoot portion and the ease of deformability of the sole 10 in accordance with the movement of the foot, and thereby provide the sole 10 and the shoe 1 with a function of assisting the forward start-off action requiring an instantaneous speed.

As shown in FIG. 1, the shoe 1 includes the sole 10 and an upper 50. The sole 10 has a substantially flat shape, and includes: a top surface defining a supporting surface 11 (see FIGS. 2, 4, 6A to 6E, and the like) that supports a bottom of the wearer's foot; a bottom surface defining a ground contact surface 12 that lands on the ground during use such as during walking and running; and a medial foot-side side surface and a lateral foot-side side surface that connect the top surface and the bottom surface. The sole 10 is a member that supports the bottom of the wearer's foot. The upper 50 is located above the sole 10 and shaped to cover the substantially entire portion extending from an ankle of the inserted wearer's foot to a distal end.

As shown in FIGS. 2 to 5, the sole 10 is divided into a forefoot portion R1, a midfoot portion R2, and a rearfoot portion R3 in a front-rear direction (in an up-down direction in FIGS. 2 and 3 and a left-right direction in FIGS. 4 and 5) that corresponds to a foot length direction of the wearer's foot in a plan view. The forefoot portion R1 supports a toe portion and a ball portion of the wearer's foot, the midfoot portion R2 supports an arch portion of the wearer's foot, and the rearfoot portion R3 supports a heel portion of the wearer's foot.

In this case, with reference to the front end of the sole 10, a first boundary position is defined at a position located at 40% of the dimension of the sole 10 from the front end in the front-rear direction, and a second boundary position is defined at a position located at 80% of the dimension of the sole 10 from the front end in the front-rear direction. In this case, the forefoot portion R1 corresponds to a portion included between the front end and the first boundary position in the front-rear direction, the midfoot portion R2 corresponds to a portion included between the first boundary position and the second boundary position in the front-rear direction, and the rearfoot portion R3 corresponds to a portion included between the second boundary position and the rear end of the shoe sole in the front-rear direction.

Further, as shown in FIGS. 2 and 3, the sole 10 is divided into a medial foot-side portion (a portion on the S1 side shown in the figure) and a lateral foot-side portion (a portion on the S2 side shown in the figure) in the left-right direction corresponding to a foot width direction of the wearer's foot (in the left-right direction in the figure) when viewed in a plan view. In this case, the medial foot-side portion corresponds to the medial side of the foot in anatomical position (i.e., the side close to the midline) and the lateral foot-side portion is opposite to the medial side of the foot in anatomical position (i.e., the side away from the midline).

In this case, a center line of the sole 10 in the left-right direction as a boundary line that divides the sole 10 into the medial foot-side portion and the lateral foot-side portion is what is called a shoe center SC. The shoe center SC is an imaginary straight line obtained by projecting a straight line onto the sole 10 in the up-down direction (i.e., the direction orthogonal to both the front-rear direction and the left-right direction described above) in the state in which a standard wearer having a foot size suitable for the shoe 1 wears the shoe 1, the straight line connecting a central portion of a calcaneus bone (what is called a heel center (the heel center is indicated by a reference character "HC" in FIGS. 2 and 3 and the like)) to a portion between the first toe and the second toe of this standard wearer. The front end and the rear end of the sole 10 described above correspond to the ends of the sole 10 located on the shoe center SC.

As shown in FIG. 1, the upper 50 includes an upper body 51, a shoe tongue 52, and a shoelace 53. Among them, the shoe tongue 52 and the shoelace 53 each are fixed or attached to the upper body 51.

The upper body 51 has a top portion provided with a top side opening through which the upper portion of an ankle of the wearer's foot and a part of the instep of the wearer's foot are exposed. Further, the upper body 51 has a bottom portion provided with, as one example, a bottom side opening covered by the sole 10 and, as another example, a bottom portion formed by stitching the bottom end of the upper body 51 with French seam or the like.

The shoe tongue 52 is fixed to the upper body 51 by sewing, welding, bonding, or a combination thereof so as to cover a portion of the top side opening provided in the upper body 51 through which a part of the instep of the wearer's foot is exposed. For the upper body 51 and the shoe tongue 52, for example, woven fabric, knitted fabric, nonwoven fabric, synthetic leather, resin, or the like may be used. For shoes particularly required to be air permeable and lightweight, a double raschel warp knitted fabric with a polyester yarn knitted therein may be used.

The shoelace 53 is formed of a member in the form of a string for pulling together, in the foot width direction of the wearer's foot, portions of a peripheral edge of the top side opening which is provided in the upper body 51 and through which a part of the instep of the wearer's foot is exposed. The shoelace 53 is passed through a plurality of holes provided along the peripheral edge of the top side opening. When the shoelace 53 is tightened in the state in which the wearer's foot is inserted into the upper body 51, the upper body 51 can be brought into close contact with the foot.

As shown in FIGS. 1 to 7, the sole 10 includes a midsole 20, an outsole 30, and a reinforcing member 40. In this case, in FIGS. 1 to 5 and 7, in order to facilitate understanding, the reinforcing member 40 is shown in dark color (also in FIG. 8 and FIGS. 9A, 9B, 10A, and 10B described later, the reinforcing member 40 is similarly shown in dark color).

The midsole 20 is disposed in a top side area of the sole 10 while the outsole 30 is disposed in a bottom side area of the sole 10. The reinforcing member 40 is interposed between the midsole 20 and the outsole 30 to be sandwiched therebetween.

As shown in FIGS. 1 to 8, the midsole 20 is a portion serving as a base of the sole 10 and is located to continuously extend from the forefoot portion R1 through the midfoot portion R2 to the rearfoot portion R3. The midsole 20 has a substantially flat plate shape and is relatively thicker than the outsole 30 which will described later. Note that the midsole 20 may be formed of a single member or may be divided into a plurality of members.

Referring particularly to FIG. 7, the midsole 20 includes a top surface 21, a bottom surface 22, a medial foot-side side surface 23, and a lateral foot-side side surface 24, among which the top surface 21 defines the above-mentioned supporting surface 11 of the sole 10. The top surface 21 of the midsole 20 is bonded to the upper body 51, for example, by adhesion or the like, and thereby, the sole 10 is fixed to the upper 50 (see FIG. 1).

The top surface 21 of the midsole 20 has a peripheral edge shaped to protrude more than the surrounding area. Thereby, the top surface 21 of the midsole 20 is provided with a recessed portion in which the upper 50 is received. The top surface 21 of the midsole 20 in the portion of the bottom surface of this recessed portion that excludes the above-mentioned peripheral edge has a smooth curved surface so as to be fitted to the bottom of the wearer's foot.

The midsole 20 is preferably excellent in shock absorbing performance while having proper strength. From this viewpoint, the midsole 20 is made, for example, using a resin-made foam material containing: a resin material as a main component; and a foaming agent and a cross-linking agent as sub-components. Alternatively, the midsole 20 may be made using a rubber-made foam material containing: a rubber material as a main component; and a plasticizer, a foaming agent, a reinforcing agent, and a cross-linking agent as sub-components.

Examples of the above-mentioned resin material applicable in this case may be an ethylene-vinyl acetate copolymer (EVA), a polyolefin resin, thermoplastic polyurethane, a thermoplastic polyamide-based elastomer (TPA, TPAE), a thermoplastic polyester-based elastomer, or the like. As the above-mentioned rubber material, for example, butadiene rubber may be suitably applicable.

Thereby, the midsole 20 is generally formed of a soft member with a low elastic modulus. Thus, the midsole 20 is relatively easily elastically deformed when it receives a compressive load, and thereby, attains excellent shock absorbing performance.

As shown in FIGS. 1 to 7, the outsole 30 is installed mainly in the midsole 20 and has a substantially flat plate shape. The outsole 30 is located to cover the bottom surface 22 of the midsole 20 and is relatively thinner than the midsole 20.

Referring particularly to FIG. 7, the outsole 30 includes a top surface 31 and a bottom surface 32, among which the bottom surface 32 defines the above-mentioned ground contact surface 12 of the sole 10. In order to improve the grip performance, the bottom surface 32 of the outsole 30 is provided with protrusions and recesses to form a tread pattern, as will be described later. The top surface 31 of the outsole 30 is bonded mainly to the bottom surface 22 of the midsole 20 by adhesion or the like, and in addition, bonded to the reinforcing member 40, for example, by adhesion or the like.

The outsole 30 may be formed of a single member or may be divided into a plurality of members. Further, the outsole 30 may be located to extend continuously, for example, from the forefoot portion R1 through the midfoot portion R2 to the rearfoot portion R3 or may be provided only in the forefoot portion R1 and the rearfoot portion R3 except for the midfoot portion R2.

In the present embodiment, the outsole 30 is divided into a front-side outsole 30A, a rear medial foot-side outsole 30B1, and a rear lateral foot-side outsole 30B2. More specifically, the front-side outsole 30A is located to extend in the entire forefoot portion R1 and a front end-side portion of the midfoot portion R2. The rear medial foot-side outsole 30B1 is located in a rear end-side portion on the medial foot side in the midfoot portion R2 and in a portion on the medial foot side in the rearfoot portion R3. The rear lateral foot-side outsole 30B2 is located in a rear end-side portion on the lateral foot side in the midfoot portion R2, in a front end-side portion on the lateral foot side in the rearfoot portion R3, and in a rear end-side portion on the medial foot side in the rearfoot portion R3.

The outsole 30 is preferably excellent in wear resistance and grip performance. From this viewpoint, the outsole 30 is formed using a member, for example, made of a material containing: a rubber material as a main component; and a plasticizer, a reinforcing agent, and a cross-linking agent as subcomponents. As the rubber material, for example, butadiene rubber can be suitably used.

Thereby, the outsole 30 is substantially formed of a hard member with a high elastic modulus. Thus, the outsole 30 is excellent in durability such as wear resistance.

As shown in FIGS. 1 to 8, the reinforcing member 40 is mainly installed in the midsole 20 and the most part thereof is formed of a thin plate-like member. The reinforcing member 40 serves mainly to locally increase the rigidity of the sole 10.

The reinforcing member 40 is located to extend in the lateral foot-side portion of the forefoot portion R1, the medial foot-side portion and the lateral foot-side portion of the midfoot portion R2, and the lateral foot-side portion of the rearfoot portion R3. More specifically, the reinforcing member 40 is located in portions of the forefoot portion R1 that correspond to the lateral foot-side portion of the bottom surface 22 of the midsole 20 and the lateral foot-side side surface 24 of the midsole 20, and covers most of these surfaces of the midsole 20. Further, the reinforcing member 40 is located in portions of the midfoot portion R2 that correspond to the bottom surface 22, the medial foot-side side surface 23, and the lateral foot-side side surface 24 of the midsole 20, and covers most of these surfaces of the midsole 20. Further, the reinforcing member 40 is located in portions of the rearfoot portion R3 that correspond to the top surface 21 and the lateral foot-side side surface 24 of the midsole 20, and covers parts of these surfaces of the midsole 20.

As described above, the reinforcing member 40 is interposed between the midsole 20 and the outsole 30, and most of the reinforcing member 40 is sandwiched between the midsole 20 and the outsole 30. In particular, the reinforcing member 40 has a portion located in the front end portion of the midfoot portion R2 and in the forefoot portion R1 and covering the bottom surface 22 of the midsole 20, and this portion is located in the state of being sandwiched between the midsole 20 and the outsole 30.

The reinforcing member 40 has: a top surface bonded to the bottom surface 22 of the midsole 20, for example, by adhesion or the like; and a bottom surface bonded to the top surface 31 of the outsole 30, for example, by adhesion or the like. Further, not only the top surface of the reinforcing member 40 but also the surfaces of the portions of the reinforcing member 40 that cover the top surface 21, the medial foot-side side surface 23, and the lateral foot-side side surface 24 of the midsole 20 are bonded to these surfaces of the midsole 20, for example, by adhesion or the like.

The reinforcing member 40 is formed of a member higher in rigidity than the midsole 20, and more preferably formed of a member higher in rigidity than the outsole 30. In other words, the reinforcing member 40 is higher in elastic modulus and higher in hardness than the midsole 20, and more preferably higher in elastic modulus and higher in hardness than the outsole 30.

The materials of the reinforcing member 40 are not particularly limited, but examples of the materials suitably applicable in this case may be: non-fiber-reinforced resin made of a polymer resin such as a urethane-based thermoplastic elastomer (TPU), an amide-based thermoplastic elastomer (TPA), or an ethylene-vinyl acetate copolymer (EVA); or fiber-reinforced resin formed using, as reinforcing fibers, carbon fibers, glass fibers, aramid fibers, Dyneema fibers, Zylon fibers, boron fibers, or the like. In addition to the above, the reinforcing member 40 may be made of rubber, or may be made of the same type of material as that forming the midsole 20 on the condition that the reinforcing member 40 is higher in rigidity than the midsole 20.

In this case, as shown in FIGS. 2 to 8, the reinforcing member 40 includes a first bar 41, a second bar 42, a third bar 43, a fourth bar 44, a fifth bar 45, a connection portion 46, a medial foot-side rising portion 47, a lateral foot-side rising portion 48, and an extension portion 49.

Referring particularly to FIGS. 3 and 8, the first bar 41 is located to extend in the forefoot portion R1 and the midfoot portion R2, and extends substantially in the front-rear direction to extend along the lateral foot-side end portion of the midsole 20. The first bar 41 has a substantially plate shape that covers the bottom surface 22 of the midsole 20.

The second bar 42 is located in the forefoot portion R1 and extends in an oblique direction to extend rearward toward the medial foot side in the left-right direction. The second bar 42 has one end connected to the first bar 41 and the other end terminating at an intermediate position in the bottom surface 22 of the midsole 20. More specifically, the other end of the second bar 42 is located on the lateral foot side with respect to the shoe center SC, so that the second bar 42 is located only in the lateral foot-side portion in the forefoot portion R1 of the sole 10. The second bar 42 has a substantially plate shape that covers the bottom surface 22 of the midsole 20.

The third bar 43 is located to extend over a boundary portion between the forefoot portion R1 and the midfoot portion R2, and protrudes toward the medial foot side from a portion of the first bar 41 that is located at this boundary portion. The third bar 43 has a shape tapering toward the medial foot side when viewed in the up-down direction. In the present embodiment, the third bar 43 has a substantially triangular shape protruding from the first bar 41. Thereby, particularly as shown in FIG. 8, a front edge 43*a* of the third bar 43 extends in the oblique direction to extend rearward toward the medial foot side in the left-right direction, and a rear edge 43*b* of the third bar 43 extends in the oblique direction to extend forward toward the medial foot side in the left-right direction. The medial foot-side end portion of the third bar 43 is located on the lateral foot side with respect to the shoe center SC, so that the third bar 43 is located only in the lateral foot-side portion of the sole 10. The third bar 43 has a substantially plate shape that covers the bottom surface 22 of the midsole 20.

In this case, particularly as shown in FIG. 8, the lateral foot-side portion of the sole 10 where the third bar 43 is provided overlaps with a portion Q2 that supports a hypothenar of the wearer's foot. More strictly, in the present embodiment, the portion Q2 that supports the hypothenar of the wearer's foot is covered by the first bar 41 and the third bar 43, and thus, the portion Q2 that supports the hypothenar is formed of the midsole 20, the reinforcing member 40, and the outsole 30. Note that a portion Q1 that supports a ball of the wearer's foot is not covered by the reinforcing member 40, and thus, this portion in the sole 10 is formed only of the midsole 20 and the outsole 30.

The fourth bar 44 is located in the forefoot portion R1 and extends in the oblique direction to extend rearward toward the medial foot side in the left-right direction. The fourth bar 44 has one end connected to a portion of the first bar 41 that is located between the second bar 42 and the third bar 43, and also has the other end terminating at an intermediate position in the bottom surface 22 of the midsole 20. More specifically, the other end of the fourth bar 44 is located on the lateral foot side with respect to the shoe center SC, so that the fourth bar 44 is located only in the lateral foot-side portion in the forefoot portion R1 of the sole 10. The fourth bar 44 has a substantially plate shape that covers the bottom surface 22 of the midsole 20.

The fifth bar 45 is located in the midfoot portion R2 and extends substantially in the front-rear direction to extend along the medial foot-side end portion of the midsole 20. The fifth bar 45 has a substantially plate shape that covers the bottom surface 22 of the midsole 20.

The connection portion 46 is located in the midfoot portion R2 and extends in the oblique direction to extend rearward toward the medial foot side in the left-right direction. The connection portion 46 has one end connected to a portion of the first bar 41 that is located rearward of the third bar 43, and also has the other end connected to the fifth bar 45. The connection portion 46 has a substantially plate shape that covers the bottom surface 22 of the midsole 20.

Referring particularly to FIG. 4, the medial foot-side rising portion 47 is located in the midfoot portion R2 and provided to rise from the medial foot-side end portion of the fifth bar 45. The medial foot-side rising portion 47 has a substantially plate shape that covers a part of the medial foot-side side surface 23 of the midsole 20.

Referring particularly to FIG. 5, the lateral foot-side rising portion 48 is located to extend in the forefoot portion R1, the midfoot portion R2, and the rearfoot portion R3, and provided to rise from the lateral foot-side end portion of the first bar 41. The lateral foot-side rising portion 48 has a substantially plate shape that covers a part of the lateral foot-side side surface 24 of the midsole 20.

The lateral foot-side rising portion 48 located in the rear end-side portion of the midfoot portion R2 is provided with a through hole 48*a* penetrating the lateral foot-side rising portion 48 in the left-right direction. The through hole 48*a* extends in the front-rear direction along the lateral foot-side side surface 24 of the midsole 20 and has a shape inclined downward to the front side.

Referring particularly to FIG. 2, the extension portion 49 is located in the rearfoot portion R3 and extends from the top end of the lateral foot-side rising portion 48 toward the medial foot side. The extension portion 49 has a substantially plate shape that covers a part of the top surface 21 of the midsole 20.

As shown in FIG. 7, in a portion of the surface of the midsole 20 that is covered by the reinforcing member 40, a receiving portion 25 is provided that is formed of a stepped portion corresponding in shape to the reinforcing member 40. Thereby, in the state in which the reinforcing member 40 is installed in the midsole 20, the reinforcing member 40 is received in the receiving portion 25, and the exposed surface of the midsole 20 is smoothly contiguous to the exposed surface of the reinforcing member 40, which prevents occurrence of an undesired step in the boundary therebetween. Thus, in the configuration as described above, the outsole 30 can be formed to have a uniform thickness, and the midsole 20, the outsole 30, and the reinforcing member 40 can be easily assembled with each other.

In this case, in the sole 10 according to the present embodiment and the shoe 1 including the sole 10, referring particularly to FIG. 8, an interposed portion 26 as a part of the midsole 20 made of a material lower in rigidity than the reinforcing member 40 is located in the medial foot-side portion of the forefoot portion R1 specifically in a portion between the second bar 42 and the fourth bar 44 and also in a portion between the fourth bar 44 and the third bar 43. Each of the interposed portions 26 is formed of a part of the midsole 20 in which the reinforcing member 40 is not disposed when viewed in the up-down direction, and extends in the same direction as the extending directions of the second bar 42, the fourth bar 44, and the front edge 43*a* of the third bar 43. In other words, each of the interposed portions 26 extends in the oblique direction to extend rearward toward the medial foot side in the left-right direction.

Thus, in the configuration as described above, with respect to the extending direction of each of the interposed portions 26 as an axis, bending deformation easily occurs in a portion of the sole 10 in which the second bar 42 is disposed and in a portion of the sole 10 in which the fourth bar 44 is disposed. Also, bending deformation easily occurs in a portion of the sole 10 in which the fourth bar 44 is disposed and in a portion of the sole 10 in which the third bar 43 is disposed. Accordingly, in the medial foot-side portion of the forefoot portion R1, the sole 10 easily undergoes bending deformation in the direction orthogonal to the extending directions of the second bar 42, the fourth bar 44, and the front edge 43*a* of the third bar 43.

In other words, by employing this configuration, the bending deformation in the specific direction as described above is allowed to easily occur while increasing the flexural rigidity in the medial foot-side portion in the forefoot portion R1 of the sole 10, as compared with the case where the sole 10 does not include the reinforcing member 40. The direction in which the bending deformation easily occurs coincides with the moving direction of the center point of the pressure applied to the sole 10 from when a foot as a pull-back foot lands on the ground to when it lifts off the ground during the forward start-off action requiring an instantaneous speed. Thus, in the configuration as described above, the sole 10 and the shoe 1 are deformed to more easily follow the movement of the wearer's foot.

Thus, the sole 10 according to the present embodiment and the shoe 1 including the sole 10 allow both an increase in flexural rigidity of the sole 10 in the forefoot portion R1 and the ease of deformability of the sole 10 in accordance with the movement of the wearer's foot. This increases the moving speed of the center point of the pressure applied to the sole 10 from when a foot (a pull-back foot) lands on the ground to when it lifts off the ground during the forward start-off action requiring an instantaneous speed, and thereby, the force of kicking the ground can be increased, with the result that the forward propulsive force can be increased. Therefore, the function of assisting the start-off action is provided, and thus, it becomes possible to implement: a sole allowing the start-off action to be performed quickly with high propulsive force; and a shoe including the sole.

In this case, the connection portion provided as a front end of the second bar 42 and connected to the first bar 41 is preferably located on the front side of the first interphalangeal joint of the wearer's foot. This makes it possible to increase the deformability of the sole 10 in accordance with the movement of the wearer's foot, and thereby makes it possible to further improve the followability of the sole 10 and further increase the propulsive force during the above-mentioned start-off action.

The widths of the second bar 42 and the fourth bar 44 are not particularly limited but are preferably 8 mm or more. This makes it possible to increase the flexural rigidity of the sole 10 in the forefoot portion R1 while maintaining the ease of deformability of the sole 10 in accordance with the movement of the wearer's foot. Further, the widths of the second bar 42 and the fourth bar 44 do not have to be uniform in their respective extending directions, or may taper away from the first bar 41. Further, the shapes of the distal end portions of the second bar 42 and the fourth bar 44 can be variously changed.

Further, in the present embodiment, the other end of the second bar 42 (i.e., the end portion not connected to the first bar 41) and the other end of the fourth bar 44 (i.e., the end portion not connected to the first bar 41) are disposed on the lateral foot side with respect to the shoe center SC, but may be disposed to overlap with the shoe center SC or may be disposed beyond the shoe center SC to reach the medial foot side. However, when the second bar 42 and the fourth bar 44 are configured to be longer than necessary, the flexural rigidity of the sole 10 in the forefoot portion R1 may be increased more than necessary. Thus, the above-mentioned other ends are more preferably disposed on the lateral foot side with respect to the shoe center SC.

Further, in the sole 10 according to the present embodiment and the shoe 1 including the sole 10, when viewed in the up-down direction, the third bar 43 is configured to taper toward the medial foot side and disposed to overlap with the portion Q2 that supports the hypothenar of the wearer's foot. This allows the sole 10 to easily bend and deform in accordance with the movement of the wearer's foot, so that the followability of the sole 10 can be further improved. Note that the shape of the third bar 43 is not necessarily limited to a substantially triangular shape, but may be a substantially trapezoidal shape, a semicircular shape, or a semi-elliptical shape as long as the third bar 43 has a tapered shape.

In addition, in the present embodiment, one end portion of the third bar 43 opposite to the other end portion connected to the first bar 41 is disposed on the lateral foot side with respect to the shoe center SC, but may be disposed to overlap with the shoe center SC or may be disposed beyond the shoe center SC to reach the medial foot side. However, when the third bar 43 is configured to be longer than necessary, the flexural rigidity of the sole 10 in the forefoot portion R1 and the midfoot portion R2 may be increased more than necessary. Thus, this one end portion of the third bar 43 is more preferably disposed on the lateral foot side with respect to the shoe center SC.

In this case, in the sole 10 according to the present embodiment and the shoe 1 including the sole 10, an interposed portion 27 as a part of the midsole 20 made of a material lower in rigidity than the reinforcing member 40 is located in the midfoot portion R2 specifically in a portion between the first bar 41 and the connection portion 46 and in a portion between the fifth bar 45 and the connection portion 46. Each of the interposed portions 27 is formed of a part of the midsole 20 in which the reinforcing member 40 is not disposed when viewed in the up-down direction, and extends substantially in the same direction as the extending direction of the connection portion 46. In other words, each of the interposed portions 27 extends in the oblique direction to extend rearward toward the medial foot side in the left-right direction.

Thus, in the configuring as described above, with respect to the extending direction of each of the interposed portions 27 as an axis, twisting easily occurs in a portion between the medial foot-side portion of the forefoot portion R1 and the lateral foot-side portion of the rearfoot portion R3. Thereby, the impulse of braking applied during a cutting maneuver increases, thus implementing not only the function of assisting the forward start-off action requiring an instantaneous speed as described above, but also the function of achieving a quick and smooth cutting maneuver (change in direction in the left-right direction).

Further, in the configuration as described above, the connection portion 46 extends in the direction intersecting the left-right direction to thereby increase the flexural rigidity against the dorsal flexion of the sole 10 around the left-right direction as an axis, and also thereby implement the function of assisting the acceleration at the start-off action during a cutting maneuver.

Further, in the sole 10 according to the present embodiment and the shoe 1 including the sole 10, referring particularly to FIGS. 4 and 5, the reinforcing member 40 is provided with the medial foot-side rising portion 47 and the lateral foot-side rising portion 48 that respectively cover the medial foot-side side surface 23 and the lateral foot-side side surface 24 of the midsole 20. This configuration makes it possible to locally increase the flexural rigidity of the medial foot-side end portion and the lateral foot-side end portion in the sole 10.

In this case, it is preferable that, during the forward start-off action requiring an instantaneous speed, the heel portion of the wearer's foot is supported by the sole and thereby prevented from sinking. When the heel portion of the wearer's foot sinks, the movement of the center point of the pressure applied to the sole from when a foot (a pull-back foot) lands on the ground to when it lifts off the ground does not stop at the center position in the left-right direction at the boundary between the forefoot portion and the midfoot portion, but the center point further moves to the rear side. This may increase the time period during which the foot contacts the ground and thereby may prevent a quick start-off action.

In this respect, in the present embodiment, in the midfoot portion R2 and the rearfoot portion R3, not only the first bar 41, the fifth bar 45, and the connection portion 46 of the reinforcing member 40 are located, but also the medial foot-side rising portion 47 and the lateral foot-side rising portion 48 are located, as described above. Thus, the flexural rigidity of the sole 10 in the midfoot portion R2 and the rearfoot portion R3 is significantly increased. In particular, the medial foot-side rising portion 47 and the lateral foot-side rising portion 48 are provided to rise from the first bar 41 and the fifth bar 45. This also increases the rigidity of the reinforcing member 40 itself, and thus, the flexural rigidity of the sole 10 in the midfoot portion R2 and the rearfoot portion R3 is dramatically increased.

Therefore, in the configuration as described above, the heel portion of the wearer's foot is reliably supported by the sole 10 during the start-off action, and thereby can be prevented from sinking, so that a quick start-off action can be achieved. In particular, in the present embodiment, the lateral foot-side rising portion 48 is provided to extend in the forefoot portion R1, the midfoot portion R2, and the rearfoot portion R3, and thereby, the flexural rigidity of the lateral foot-side end portion of the sole 10 is significantly increased, so that sinking of the heel portion of the wearer's foot during the start-off action can be more effectively suppressed.

In addition, in the sole 10 according to the present embodiment and the shoe 1 including the sole 10, particularly as shown in FIG. 2, the extension portion 49 that covers the top surface 21 of the midsole 20 is provided in the rearfoot portion R3, which results in a configuration in which the midsole 20 is sandwiched between and held by the extension portion 49 and the portion of the reinforcing member 40 (i.e., the fifth bar 45, the connection portion 46, and the like) that covers the bottom surface 22 of the midsole 20. This makes it possible to suppress occurrence of shear deformation in the midsole 20 during the start-off action. Also in this respect, sinking of the heel portion of the wearer's foot during the start-off action can be more effectively suppressed.

In addition, the through hole 48*a* is provided in the lateral foot-side rising portion 48 as described above mainly for reducing the weight. In such a configuration, the rigidity of the reinforcing member 40 can be increased to thereby increase the flexural rigidity of the sole 10 while an increase in weight of the sole 10 can also be suppressed.

Referring to FIGS. 3 to 8, in the sole 10 according to the present embodiment and the shoe 1 including the sole 10, the front-side outsole 30A is provided with a plurality of groove portions. The plurality of groove portions provide tread patterns and include a first groove portion 33, a second groove portion 34, a third groove portion 35, a fourth groove portion 36, and a plurality of minute groove portions 38. In FIG. 8, the first groove portion 33, the second groove portion 34, the third groove portion 35, and the fourth groove portion 36 are shown by imaginary lines (two-dot chain lines).

Referring particularly to FIGS. 3 and 8, the first groove portion 33 is provided in the bottom surface 32 of the front-side outsole 30A and extends in a curved shape to reach the lateral foot-side end portion of the front-side outsole 30A. The first groove portion 33 is located to traverse a portion located between the third bar 43 and the fourth bar 44 when viewed in the up-down direction, and extends along the front edge 43*a* of the third bar 43.

The position between the third bar 43 and the fourth bar 44 when viewed in the up-down direction is located at a position corresponding to the interposed portion 26 in the midsole 20 and also located at a position on the front side of the portion Q2 of the sole 10 that supports the hypothenar of the wearer's foot. Thus, the first groove portion 33 extends to overlap with the interposed portion 26 and traverses the area on the front side of the portion Q2 of the sole 10 that supports the hypothenar of the wearer's foot.

Further, the second groove portion 34 is provided in the bottom surface 32 of the front-side outsole 30A and extends in a curved shape to reach the lateral foot-side end portion of the front-side outsole 30A. The second groove portion 34 is located rearward of the third bar 43 when viewed in the up-down direction, and more specifically, is located to traverse portions between the third bar 43 and the connection portion 46 and also between the third bar 43 and the fifth bar 45, and extends along the rear edge 43*b* of the third bar 43.

Each of the positions between the third bar 43 and the connection portion 46 and between the third bar 43 and the fifth bar 45 when viewed in the up-down direction is located in a portion not provided with the reinforcing member 40 and also located on the rear side of the portion Q2 of the sole 10 that supports the hypothenar of the wearer's foot. Thus, the second groove portion 34 extends to overlap with the portion not provided with the reinforcing member 40 and traverses an area on the rear side of the portion Q2 of the sole 10 that supports the hypothenar of the wearer's foot.

In this case, the first groove portion 33 and the second groove portion 34 merge with each other at an intermediate position in the sole 10 in the left-right direction. In the present embodiment, a merging portion 37 where the first groove portion 33 and the second groove portion 34 merge with each other is located on the medial foot side with respect to the shoe center SC. Also, the third groove portion 35 provided as a single groove formed by the first groove portion 33 and the second groove portion 34 merging with each other further extends from the above-mentioned intermediate position toward the medial foot-side end portion of the front-side outsole 30A and thereby reaches the medial foot-side end portion.

The third groove portion 35 is provided in a portion where the reinforcing member 40 is not disposed, and is located in an area of the sole 10 specifically on the rear side of the portion Q1 that supports the ball of the wearer's foot. Thus, the third groove portion 35 extends to overlap with the portion where the reinforcing member 40 is not disposed, and traverses an area of the sole 10 specifically on the rear side of the portion Q1 that supports the ball of the wearer's foot.

Further, the fourth groove portion 36 is provided in the bottom surface 32 of the front-side outsole 30A and extends in a curved shape to reach the lateral foot-side end portion and the medial foot-side end portion of the front-side outsole 30A. The fourth groove portion 36 is located on the front side of the second bar 42 when viewed in the up-down direction and extends along the front edge of the second bar 42.

At the position on the front side of the second bar 42 when viewed in the up-down direction, the reinforcing member 40 is not disposed. Thus, the fourth groove portion 36 extends to overlap with this portion where the reinforcing member 40 is not disposed.

On the other hand, the plurality of minute groove portions 38 are narrower in width and shorter in length than any of the first groove portion 33, the second groove portion 34, the third groove portion 35, and the fourth groove portion 36, and are densely arranged in a portion of the bottom surface 32 of the front-side outsole 30A other than the portions where the first groove portion 33, the second groove portion 34, the third groove portion 35, and the fourth groove portion 36 are provided. Note that the plurality of minute groove portions 38 are similarly densely arranged not only in the front-side outsole 30A but also in the bottom surface 32 of each of the rear medial foot-side outsole 30B1 and the rear lateral foot-side outsole 30B2.

In this case, in the sole 10 according to the present embodiment and the shoe 1 including the sole 10, referring particularly to FIG. 8, the first groove portion 33, the second groove portion 34, the third groove portion 35, and the fourth groove portion 36 each are located to traverse the portion where the reinforcing member 40 is not disposed. Among these groove portions, the first groove portion 33 particularly traverses the interposed portion 26 of the midsole 20. Therefore, in the portions where the first groove portion 33, the second groove portion 34, the third groove portion 35, and the fourth groove portion 36 are provided, the sole 10 easily undergoes bending deformation around the extending directions of these groove portions each as an axis.

The direction in which the bending deformation easily occurs coincides with the moving direction of the center point of the pressure applied to the sole 10 from when a foot (a pull-back foot) lands on the ground to when it lifts off the ground during the forward start-off action requiring an instantaneous speed, and also, allows enhancement of the deformability of the sole 10 in accordance with the movement of the wearer's foot. Thus, in combination with the configuration in which the interposed portion 26 formed of the midsole 20 is provided between the third bar 43 and the fourth bar 44 as described above, the sole 10 and the shoe 1 are deformed to further easily follow the movement of the wearer's foot.

Therefore, the configuration as described above makes it possible to further enhance the above-described function of assisting the forward start-off action requiring an instantaneous speed, and thereby makes it possible to implement a sole allowing the start-off action to be performed more quickly with higher propulsive force and a shoe including the sole.

The width of each of the first groove portion 33, the second groove portion 34, the third groove portion 35, and the fourth groove portion 36 is not particularly limited but is preferably 4 mm or more. This makes it possible to significantly improve the ease of deformability of the sole 10 in accordance with the movement of the wearer's foot.

Further, in each of the first groove portion 33 and the second groove portion 34, the groove depth is preferably smaller in the medial foot-side end portion than in the lateral foot-side end portion. In the configuration as described above, the flexural rigidity of the sole 10 can be lower in the lateral foot-side portion than in the medial foot-side portion. Thereby, the deformability of the lateral foot-side portion of the sole 10 can be further enhanced, and thus, the sole 10 and the shoe 1 can be deformed to further follow the movement of the wearer's foot.

In this case, the bottom surface of each of the first groove portion 33 and the second groove portion 34 may be formed as an inclined surface such that the depth of each groove portion gradually decreases from the medial foot-side end portion toward the lateral foot-side end portion, or may be formed in a stepped shape such that the depth of each groove portion decreases in a stepwise manner. Further, the groove depths do not necessarily have to decrease uniformly from the medial foot-side end portion toward the lateral foot-side end portion, but the groove depths may locally decrease or locally increase.

Further, each of the third groove portion 35 and the fourth groove portion 36 may also be configured such that the groove depth is smaller in the medial foot-side end portion than in the lateral foot-side end portion, similarly to the groove depths of the first groove portion 33 and the second groove portion 34. Further, the groove depth may be smaller in the third groove portion 35 than in the first groove portion 33 and the second groove portion 34.

Further, the first groove portion 33, the second groove portion 34, the third groove portion 35, and the fourth groove portion 36 do not necessarily have to reach the medial foot-side end portion or/and the lateral foot-side end portion of the front-side outsole 30A, but may terminate at an intermediate position in the bottom surface 32 of the front-side outsole 30A in the left-right direction.

Further, in the sole 10 according to the present embodiment and the shoe 1 including the sole 10, referring particularly to FIG. 3, the plurality of minute groove portions 38 are densely arranged in a portion of the bottom surface 32 of the front-side outsole 30A other than the portions where the first groove portion 33, the second groove portion 34, the third groove portion 35, and the fourth groove portion 36 are provided. In the configuration as described above, the deformability of the sole 10 can be enhanced without impairing the grip performance, and thus, the sole 10 and the shoe 1 can be deformed to further follow the movement of the wearer's foot.

In this case, when viewed in the up-down direction, the plurality of minute groove portions 38 are oriented to be aligned substantially radially substantially around the portion Q1, as a center point, that supports the ball of the wear's foot. In other words, each of the minute groove portions 38 has an elongated shape extending in a prescribed direction and is arranged such that one end in the longitudinal direction substantially faces the portion Q1 that supports the ball of the wearer's foot and the other end in the longitudinal direction faces the side opposite thereto.

According to the configuration as described above, in the portion on the front side of the portion Q1 that supports the ball of the wearer's foot, the plurality of minute groove portions 38 extend substantially in the front-rear direction, so that the ground contact surface 12 having a mesh-like shape in a plan view and provided adjacent to the minute groove portions 38 also extends substantially in the front-rear direction. Thus, the moving direction of the center point of the pressure applied to the sole from when a foot (a pull-back foot) lands on the ground to when it lifts off the ground coincides with the above-mentioned front-rear direction of extension of the plurality of minute groove portions 38 and the ground contact surface 12 having a mesh-like shape, which improves the grip performance at the portion on the front side of the portion Q1. Thereby, the forward start-off action requiring an instantaneous speed can be performed more quickly with higher propulsive force.

On the other hand, in the left-side portion and the right-side portion of the portion Q1 that supports the ball of the wearer's foot, the plurality of minute groove portions 38 extend substantially in the left-right direction, so that the ground contact surface 12 having a mesh-like shape in a plan view and provided adjacent to the minute groove portions 38 also extends substantially in the front-rear direction. Therefore, in the configuration as described above, the deformability of the sole 10 in accordance with the movement of the wearer's foot can be enhanced while enhancing the grip performance, and thus, the sole 10 and the shoe 1 are deformed to further easily follow the movement of the wearer's foot.

Referring to FIG. 3, the area of the ground contact surface 12 per unit area in the region on the lateral foot side between the second groove portion 34 and the fourth groove portion 36 (the region indicated by a symbol A1 in the figure) is preferably smaller than the area of the ground contact surface 12 per unit area in the region forward of the fourth groove portion 36 (the region indicated by a symbol A2 in the figure). Also, the area of the ground contact surface 12 per unit area in the region forward of the fourth groove portion 36 (i.e., the region indicated by the symbol A2 in the figure) is preferably smaller than the area of the ground contact surface 12 per unit area in the region on the medial foot side between the first groove portion 33 and the fourth groove portion 36 (the region indicated by a symbol A3 in the figure).

In other words, in the sole 10 and the shoe 1 including the sole 10, it is preferable that, during the forward start-off action requiring an instantaneous speed, the grip force generated in the regions A1, A2, and A3 of the foot as a pull-back foot satisfies the relation of (the grip force in the region A1)<(the grip force in the region A2)<(the grip force in the region A3). The configuration as described above allows smoother shift of the region of contact where the sole 10 comes into contact with the ground during the above-mentioned start-off action, so that a quick start-off action can be achieved.

As described above, the sole 10 according to the present embodiment and the shoe 1 including the sole 10 make it possible to implement a sole allowing the forward start-off action requiring an instantaneous speed to be performed quickly with high propulsive force and a shoe including the sole, from various viewpoints as described above.

<First to Fourth Modifications>

Figure 9B:
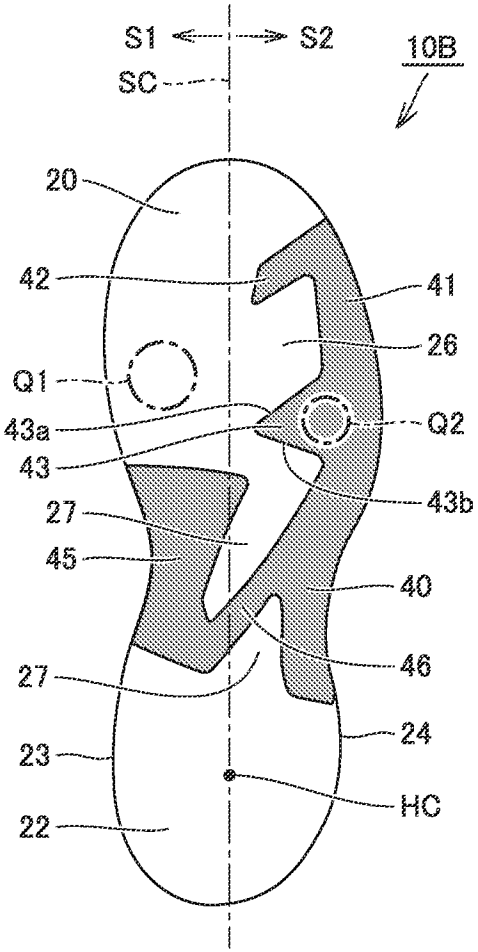
FIG. 9B is a schematic bottom view showing a state in which an outsole is removed from a sole according to a second modification.
Figure 9A:
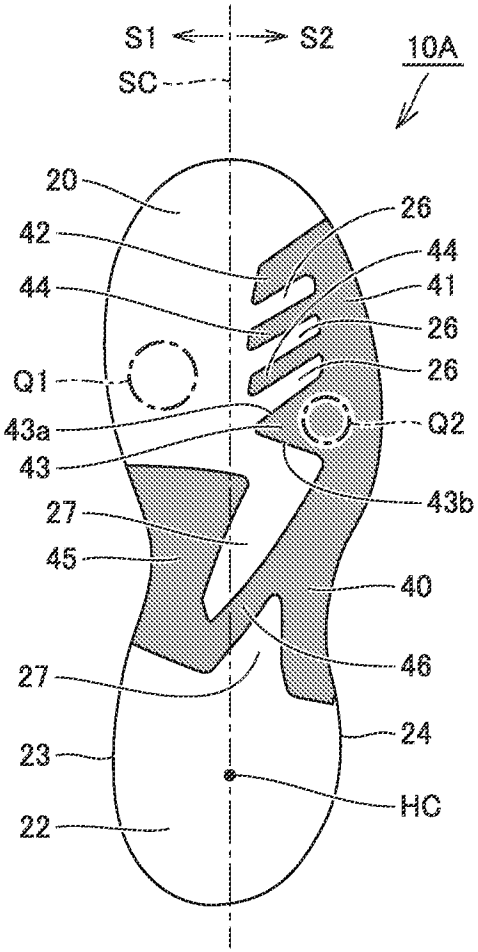
FIG. 9A is a schematic bottom view showing a state in which an outsole is removed from a sole according to a first modification.
Figure 10B:
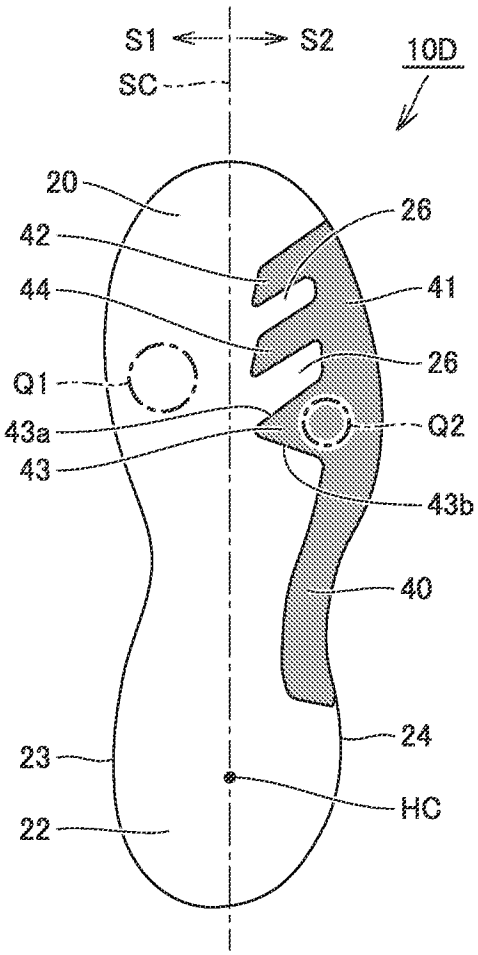
FIG. 10B is a schematic bottom view showing a state in which an outsole is removed from a sole according to a fourth modification.
Figure 10A:
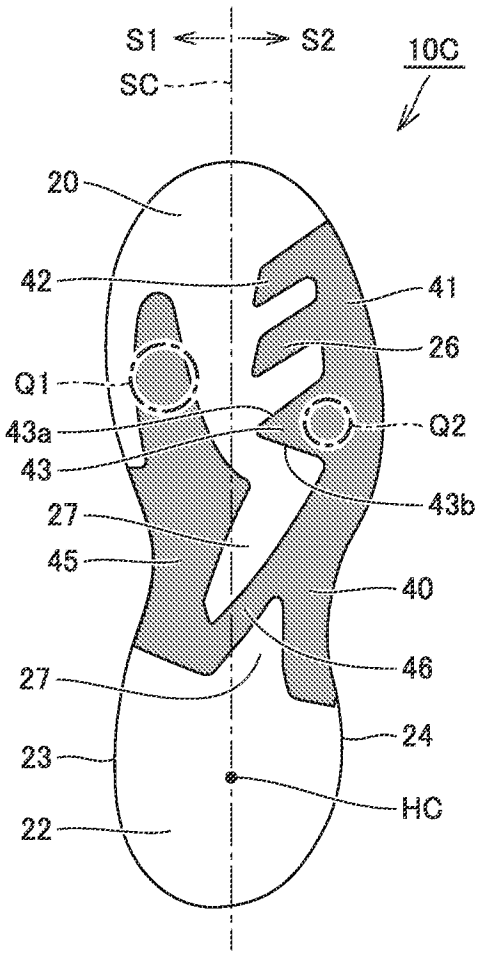
FIG. 10A is a schematic bottom view showing a state in which an outsole is removed from a sole according to a third modification.

FIG. 9A is a schematic bottom view showing the state in which an outsole is removed from a sole according to the first modification, and FIG. 9B is a schematic bottom view showing the state in which an outsole is removed from a sole according to the second modification. FIG. 10A is a schematic bottom view showing the state in which an outsole is removed from a sole according to the third modification, and FIG. 10B is a schematic bottom view showing the state in which an outsole is removed from a sole according to the fourth modification. Referring to FIGS. 9A, 9B, 10A, and 10B, the following describes soles 10A to 10D according to the first to fourth modifications based on the above-described embodiment. Note that each of the soles 10A to 10D according to the first to fourth modifications is provided in the shoe 1 in place of the sole 10 according to the above-described embodiment.

As shown in FIG. 9A, the sole 10A according to the first modification is different from the sole 10 according to the above-described embodiment only in the number of the fourth bars 44 provided in the reinforcing member 40. Specifically, the sole 10A includes two fourth bars 44 that are located at a distance from each other in the front-rear direction. Each of these two fourth bars 44 has one end connected to a portion of the first bar 41 that is located between the second bar 42 and the third bar 43. The other end of each of the two fourth bars 44 terminates at an intermediate position on the bottom surface 22 of the midsole 20 and is located on the lateral foot side with respect to the shoe center SC, so that the two fourth bars 44 each are located only in the lateral foot-side portion in the forefoot portion R1 of the sole 10.

Also in the configuration as described above, the effect similar to that described in the above embodiment can be achieved. In particular, since two fourth bars 44 are provided, a total of three interposed portions 26 are located between the second bar 42 and the third bar 43. This makes it possible to achieve an effect that the sole 10A deforms to more easily follow the movement of the wearer's foot as compared with the above-described embodiment. Note that the number of the fourth bars 44 is not limited to one or two, but may be three or more.

As shown in FIG. 9B, the sole 10B according to the second modification is different from the sole 10 according to the above-described embodiment only in that the fourth bar 44 is not provided in the reinforcing member 40. Specifically, in the sole 10B, the fourth bar 44 is not provided in a portion located between the second bar 42 and the third bar 43, and only one interposed portion 26 is located between the second bar 42 and the third bar 43.

Also in the configuration as described above, an effect similar to that described in the above embodiment can be achieved.

As shown in FIG. 10A, the sole 10C according to the third modification is different from the sole 10 according to the above-described embodiment only in the shape of the fifth bar 45 provided in the reinforcing member 40. Specifically, in the sole 10C, the fifth bar 45 extending in the front-rear direction to extend along the medial foot-side end portion of the midsole 20 reaches not only the midfoot portion R2 but also the rear end-side portion of the forefoot portion R1.

Also in the configuration as described above, an effect similar to that described in the above embodiment can be achieved. In particular, the fifth bar 45 extends to the portion Q2 of the sole 10C that supports the ball of the wearer's foot, to thereby increase the flexural rigidity against the dorsal flexion occurring in the sole 10C, so that the forward propulsive force is increased.

As shown in FIG. 10B, the sole 10D according to the fourth modification is basically different in configuration from the sole 10 according to the above-described embodiment in that the fifth bar 45 and the connection portion 46 are not provided in the reinforcing member 40. Specifically, in the sole 10D, only the first bar 41, the second bar 42, the third bar 43, and the fourth bar 44 are provided in the reinforcing member 40, and thus, the reinforcing member 40 is located only in the lateral foot-side portion of the sole 10D.

Also in the configuration as described above, an effect similar to that described in the above embodiment can be achieved. However, the fifth bar 45, the connection portion 46, and the like are not provided in the reinforcing member 40, which deteriorates the function of the sole 10D to support the heel portion of the wearer's foot during the forward start-off action requiring an instantaneous speed, but allows significant reduction in weight of the sole 10D and the shoe 1 including the sole 10D.

<Summary of the Disclosure in Embodiment and Modifications>

The following summarizes the features disclosed in the above-described embodiment and modifications thereof.

[Supplementary Note 1]

A sole including a forefoot portion that supports a toe portion and a ball portion of a foot of a wearer, a midfoot portion that supports an arch portion of the foot of the wearer, and a rearfoot portion that supports a heel portion of the foot of the wearer, the forefoot portion, the midfoot portion, and the rearfoot portion being connected in a front-rear direction corresponding to a foot length direction of the foot of the wearer, the sole comprising:

- a midsole located to continuously extend from the forefoot portion to the rearfoot portion; and
- a reinforcing member formed of a material higher in rigidity than a material forming the midsole, the reinforcing member being disposed on a bottom surface of the midsole, wherein
- the reinforcing member includes
  - a first bar located to extend at least in the forefoot portion and the midfoot portion and extending along a lateral foot-side end portion of the midsole, and
  - a second bar located in the forefoot portion and having one end connected to the first bar, the second bar extending in an oblique direction to extend rearward toward a medial foot side in a left-right direction corresponding to a foot width direction of the foot of the wearer.

[Supplementary Note 2]

The sole according to Supplementary Note 1, wherein an other end of the second bar that is opposite to the one end is located on a lateral foot side with respect to a center line of the sole in the left-right direction.

[Supplementary Note 3]

The sole according to Supplementary Note 1 or 2, wherein the reinforcing member further includes a third bar that protrudes toward the medial foot side from a portion of the first bar that includes a boundary portion between the forefoot portion and the midfoot portion, a front edge of the third bar extends in the oblique direction to extend rearward toward the medial foot side in the left-right direction, and a rear edge of the third bar extends in the oblique direction to extend forward toward the medial foot side in the left-right direction, such that the third bar has a shape tapering toward the medial foot side when viewed in an up-down direction orthogonal to both the front-rear direction and the left-right direction, and the third bar is located to overlap with at least a part of a portion of the midsole that supports a hypothenar of the foot of the wearer.

[Supplementary Note 4]

The sole according to Supplementary Note 3, wherein a medial foot-side end portion of the third bar is located on a lateral foot side with respect to a center line of the sole in the left-right direction.

[Supplementary Note 5]

The sole according to Supplementary Note 3 or 4, further comprising an outsole that at least covers the bottom surface of the midsole in a front end portion of the midfoot portion and in the forefoot portion, wherein a portion of the reinforcing member is located in the front end portion of the midfoot portion and in the forefoot portion, and interposed between the midsole and the outsole.

[Supplementary Note 6]

The sole according to Supplementary Note 5, wherein a first groove portion extending along the front edge of the third bar is provided in a portion of a bottom surface of the outsole, the portion being located between the second bar and the third bar when viewed in the up-down direction.

[Supplementary Note 7]

The sole according to Supplementary Note 6, wherein a groove depth of the first groove portion is smaller on a side of a medial foot-side end portion than on a side of a lateral foot-side end portion.

[Supplementary Note 8]

The sole according to Supplementary Note 6 or 7, wherein a second groove portion extending along the rear edge of the third bar is provided in a portion of the bottom surface of the outsole, the portion being located rearward of the third bar when viewed in the up-down direction.

[Supplementary Note 9]

The sole according to Supplementary Note 8, wherein a groove depth of the second groove portion is smaller on a side of a medial foot-side end portion than on a side of a lateral foot-side end portion.

[Supplementary Note 10]

The sole according to Supplementary Note 8 or 9, wherein the first groove portion and the second groove portion merge with each other at an intermediate position in the sole in the left-right direction.

[Supplementary Note 11]

The sole according to Supplementary Note 10, wherein a lateral foot-side end portion of the first groove portion and a lateral foot-side end portion of the second groove portion reach a lateral foot-side end portion of the outsole, and the first groove portion and the second groove portion merge with each other to provide a third groove portion in the bottom surface of the outsole, and a medial foot-side end portion of the third groove portion reaches a medial foot-side end portion of the outsole.

[Supplementary Note 12]

The sole according to any one of Supplementary Notes 5 to 11, wherein a plurality of minute groove portions are provided in a portion of a bottom surface of the outsole, the portion being located in the forefoot portion, and when viewed in the up-down direction, the plurality of minute groove portions are oriented to be aligned substantially radially substantially around a portion, as a center point, that supports a ball of the foot of the wearer.

[Supplementary Note 13]

The sole according to any one of Supplementary Notes 3 to 12, wherein the reinforcing member includes at least one fourth bar located in the forefoot portion and provided between the second bar and the third bar, and the fourth bar has one end connected to the first bar and extends in the oblique direction to extend rearward toward the medial foot side in the left-right direction.

[Supplementary Note 14]

The sole according to Supplementary Note 13, wherein an other end of the fourth bar that is opposite to the one end is located on a lateral foot side with respect to a center line of the sole in the left-right direction.

[Supplementary Note 15]

The sole according to any one of Supplementary Notes 1 to 14, wherein the reinforcing member further includes a rising portion provided to rise from a lateral foot-side end portion of the first bar to cover a lateral foot-side side surface of the midsole.

[Supplementary Note 16]

The sole according to Supplementary Note 15, wherein the rising portion is provided with a through hole penetrating the rising portion in the left-right direction.

[Supplementary Note 17]

The sole according to Supplementary Note 15 or 16, wherein the reinforcing member further includes an extension portion provided to extend from a top end of the rising portion toward the medial foot side to cover a top surface of the midsole.

[Supplementary Note 18]

The sole according to Supplementary Note 17, wherein the extension portion is located in the rearfoot portion.

[Supplementary Note 19]

The sole according to any one of Supplementary Notes 1 to 18, wherein the reinforcing member further includes a fifth bar located at least in the midfoot portion and extending along a medial foot-side end portion of the midsole, and a connection portion located in the midfoot portion and connecting the first bar and the fifth bar, and the connection portion extends in the oblique direction to extend rearward toward the medial foot side in the left-right direction.

[Supplementary Note 20]

A shoe comprising:

the sole according to any one of Supplementary Notes 1 to 19; and an upper provided above the sole.

Other Embodiments

The above-described embodiment and modifications thereof have been described basically with reference to an example of a sole including all of the configurations according to the above-described Supplementary Notes 1 to 20 and a shoe including the sole, but some of the individual characteristic configurations described in Supplementary Notes 1 to 20 may not be provided without departing from the gist of the present disclosure. In this case, some of the effects described in the above embodiment and modifications thereof cannot be achieved, but at least some of the effects described in the above embodiment and modifications thereof can be achieved as long as the sole and the shoe including the sole have the characteristic configuration described in any one of the above-described Supplementary Notes 1 to 20.

Further, the shape, the size, the number, the arrangement position, and the like of each of the portions disclosed in the above-described embodiment and modifications thereof can be variously modified without departing from the gist of the present disclosure.

Although the embodiment has been described as above, it should be understood that the embodiment disclosed herein is illustrative and non-restrictive in every respect. The scope of the present invention is defined by the scope of the claims and is intended to include any modifications within the meaning and scope equivalent to the scope of the claims.

What is claimed is:

1. A sole including a forefoot portion that is configured to support a toe portion and a ball portion of a foot of a wearer, a midfoot portion that is configured to support an arch portion of the foot of the wearer, and a rearfoot portion that is configured to support a heel portion of the foot of the wearer, the forefoot portion, the midfoot portion, and the rearfoot portion being connected in a front-rear direction corresponding to a foot length direction of the foot of the wearer, the sole comprising:

a midsole which continuously extends from the forefoot portion to the rearfoot portion; and a reinforcing member including a material higher in rigidity than a material of the midsole, the reinforcing member being on a bottom surface of the midsole, wherein the reinforcing member includes a first bar extending at least in the forefoot portion and the midfoot portion and extending along a lateral foot-side end portion of the midsole, a second bar in the forefoot portion and having one end connected to the first bar, the second bar extending in an oblique direction to extend rearward toward a medial foot side in a left-right direction corresponding to a foot width direction of the foot of the wearer, and a third bar that protrudes toward the medial foot side from a portion of the first bar that includes a boundary portion between the forefoot portion and the midfoot portion, a front edge of the third bar extends in the oblique direction to extend rearward toward the medial foot side in the left-right direction, and a rear edge of the third bar extends in the oblique direction to extend forward toward the medial foot side in the left-right direction, such that the third bar has a shape tapering toward the medial foot side when viewed in an up-down direction orthogonal to both the front-rear direction and the left-right direction, the third bar overlaps with at least a part of a portion of the midsole that is configured to support a hypothenar of the foot of the wearer, the sole further comprises an outsole that at least covers the bottom surface of the midsole in a front end portion of the midfoot portion and in the forefoot portion, a portion of the reinforcing member is in the front end portion of the midfoot portion and in the forefoot portion, and interposed between the midsole and the outsole, a first groove portion extending along the front edge of the third bar is in a portion of a bottom surface of the outsole, the portion being between the second bar and the third bar when viewed in the up-down direction, a second groove portion extending along the rear edge of the third bar is in a portion of the bottom surface of the outsole, the portion being rearward of the third bar when viewed in the up-down direction, and the first groove portion and the second groove portion merge with each other at an intermediate position in the sole in the left-right direction.

2. The sole according to claim 1, wherein a lateral foot-side end portion of the first groove portion and a lateral foot-side end portion of the second groove portion reach a lateral foot-side end portion of the outsole, and the first groove portion and the second groove portion merge with each other to provide a third groove portion in the bottom surface of the outsole, and a medial foot-side end portion of the third groove portion reaches a medial foot-side end portion of the outsole.

3. The sole according to claim 1, wherein a plurality of minute groove portions are in a portion of a bottom surface of the outsole, the portion being in the forefoot portion, and when viewed in the up-down direction, the plurality of minute groove portions are oriented to align substantially radially substantially around a portion, as a center point, that is configured to support a ball of the foot of the wearer.

4. The sole according to claim 1, wherein the reinforcing member includes at least one fourth bar in the forefoot portion and between the second bar and the third bar, and the fourth bar has one end connected to the first bar and extends in the oblique direction to extend rearward toward the medial foot side in the left-right direction.

5. The sole according to claim 4, wherein an other end of the fourth bar that is opposite to the one end is on a lateral foot side with respect to a center line of the sole in the left-right direction.

6. The sole according to claim 1, wherein the reinforcing member further includes a rising portion which rises from a lateral foot-side end portion of the first bar to cover a lateral foot-side side surface of the midsole.

7. The sole according to claim 6, wherein the rising portion includes a through hole penetrating the rising portion in the left-right direction.

8. A sole including a forefoot portion that is configured to support a toe portion and a ball portion of a foot of a wearer, a midfoot portion that is configured to support an arch portion of the foot of the wearer, and a rearfoot portion that is configured to support a heel portion of the foot of the wearer, the forefoot portion, the midfoot portion, and the rearfoot portion being connected in a front-rear direction corresponding to a foot length direction of the foot of the wearer, the sole comprising:

a midsole which continuously extends from the forefoot portion to the rearfoot portion; and a reinforcing member including a material higher in rigidity than a material of the midsole, the reinforcing member being on a bottom surface of the midsole, wherein the reinforcing member includes a first bar extending at least in the forefoot portion and the midfoot portion and extending along a lateral foot-side end portion of the midsole, a second bar in the forefoot portion and having one end connected to the first bar, the second bar extending in an oblique direction to extend rearward toward a medial foot side in a left-right direction corresponding to a foot width direction of the foot of the wearer, a rising portion which rises from a lateral foot-side end portion of the first bar to cover a lateral foot-side side surface of the midsole, and an extension portion which extends from a top end of the rising portion toward the medial foot side to cover a top surface of the midsole.

9. The sole according to claim 8, wherein the extension portion is in the rearfoot portion.

10. The sole according to claim 1, wherein the reinforcing member further includes a fifth bar at least in the midfoot portion and extending along a medial foot-side end portion of the midsole, and a connection portion in the midfoot portion and connecting the first bar and the fifth bar, and the connection portion extends in the oblique direction to extend rearward toward the medial foot side in the left-right direction.

11. A shoe comprising: the sole according to claim 1; and an upper above the sole.

12. The sole according to claim 1, wherein an other end of the second bar that is opposite to the one end is on a lateral foot side with respect to a center line of the sole in the left-right direction.

13. The sole according to claim 1, wherein a medial foot-side end portion of the third bar is on a lateral foot side with respect to a center line of the sole in the left-right direction.

14. The sole according to claim 1, wherein a groove depth of the first groove portion is smaller on a side of a medial foot-side end portion than on a side of a lateral foot-side end portion.

15. The sole according to claim 1, wherein a groove depth of the second groove portion is smaller on a side of a medial foot-side end portion than on a side of a lateral foot-side end portion.

* * * * *